US009802742B1

(12) United States Patent
Castro

(10) Patent No.: US 9,802,742 B1
(45) Date of Patent: Oct. 31, 2017

(54) ELASTIC FASTENER AND METHOD OF USE

(71) Applicant: Lionel P. Castro, Irvine, CA (US)

(72) Inventor: Lionel P. Castro, Irvine, CA (US)

( * ) Notice: Subject to any disclaimer, the term of this patent is extended or adjusted under 35 U.S.C. 154(b) by 340 days.

(21) Appl. No.: 14/630,182

(22) Filed: Feb. 24, 2015

(51) Int. Cl.
*B65D 63/10* (2006.01)

(52) U.S. Cl.
CPC ..... *B65D 63/1018* (2013.01)

(58) Field of Classification Search
CPC ..... B65D 63/1018; B65D 63/10; F16L 3/14; B60T 17/046; Y10T 24/15; Y10T 24/1406; Y10T 24/141; Y10T 24/1498; B60P 7/0823
See application file for complete search history.

(56) References Cited

U.S. PATENT DOCUMENTS 1,974,499 A * 9/1934 Luce ..... A44B 15/00 24/16 PB
3,438,095 A 4/1969 Evans
4,077,562 A 3/1978 Ballin
4,150,463 A 4/1979 Brown
4,377,872 A 3/1983 Daniell, Jr.
4,510,649 A 4/1985 Yudis
5,799,376 A 9/1998 Harsley
5,987,706 A * 11/1999 Boe ..... B65D 63/1018 24/16 PB
6,073,315 A 6/2000 Rasmussen
6,192,554 B1 2/2001 Dumcum
6,634,063 B2 10/2003 Joseph
7,377,013 B2 5/2008 Cheung
7,523,576 B1 4/2009 Petty
D615,385 S 5/2010 Arendt

* cited by examiner

*Primary Examiner* — Jack W Lavinder
(74) *Attorney, Agent, or Firm* — Eric Karich; Karich & Associates

(57) ABSTRACT

A fastener has an elastic body that extends to opposed ends, and a three dimensional sphere-like head connected to each of the ends of the elastic body. A plurality of apertures are formed through the elastic body, sized to enable one of the three dimensional sphere-like heads to be pushed through the aperture for securing the fastener. The fastener may be wrapped around two elements, and the head or heads may each be inserted through one of the apertures so that the fastener secures the two elements together.

11 Claims, 12 Drawing Sheets

ELASTIC FASTENER AND METHOD OF USE

BACKGROUND OF THE INVENTION

Field of the Invention

This invention relates generally to fasteners, and more particularly to an elastic fastener that may be wrapped around items and removably connected to itself by inserting heads at the ends of the fastener through apertures through the body of the fastener.

Description of Related Art

The prior art teaches a wide range of fasteners that may be used for fastening items together, or otherwise connecting them. This may range from fastening multiple items (e.g., cables) together, such as with a cable tie, to lacing shoes, closing the tops of sandals, or otherwise fastening a broad range of items together. Nothing in the background of the invention should be construed to limit the present invention to particular implementations, but these examples are used to illustrate some of the multiple possible uses of the present invention.

Some examples of prior art devices include Joseph, U.S. Pat. No. 6,634,063, which teaches a cable tie that includes an elastic body and a locking head. The flexible strap includes a plurality of apertures, in a manner that is similar to the present invention; however, the locking head is of different construction than the present invention, many of the details of construction are different, and the method of use of the two devices is completely different. The Joseph device further lacks many of the key improvement of the present invention, as discussed in greater detail below.

There are also several fastening devices that utilize straps with wide, flat portions that self-interlock. Daniell, Jr., U.S. Pat. No. 4,377,872 for example, teaches a resilient strap having flattened elongated links, each pair of links being rigidly joined together through interlocking between the link and the connector of a link.

The above-described references are hereby incorporated by reference in full.

SUMMARY OF THE INVENTION

The present invention teaches certain benefits in construction and use which give rise to the objectives described below.

The present invention provides a fastener comprising an elastic body that extends to opposed ends, and a three dimensional sphere-like head connected to each of the ends of the elastic body. A plurality of apertures are formed through the elastic body, sized to enable one of the three dimensional sphere-like heads to be pushed through the aperture for securing the fastener.

In another embodiment, the invention further includes a method for securing two elements together using the fastener described above. In one embodiment, includes wrapping the fastener around the two elements, and inserting at least one head through one of the apertures so that the fastener secures the two elements together.

A primary objective of the present invention is to provide a fastener having advantages not taught by the prior art.

Another objective is to provide a fastener that is inexpensive to manufacture, and easy to use.

Another objective is to provide a fastener that may be used for a broad range of purposes, or which may be readily incorporated into or used with other elements or products that require quick and easy fastening.

A further objective is to provide a fastener that maintains a strong hold when in use, but which can be readily unfastened as needed.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1A:
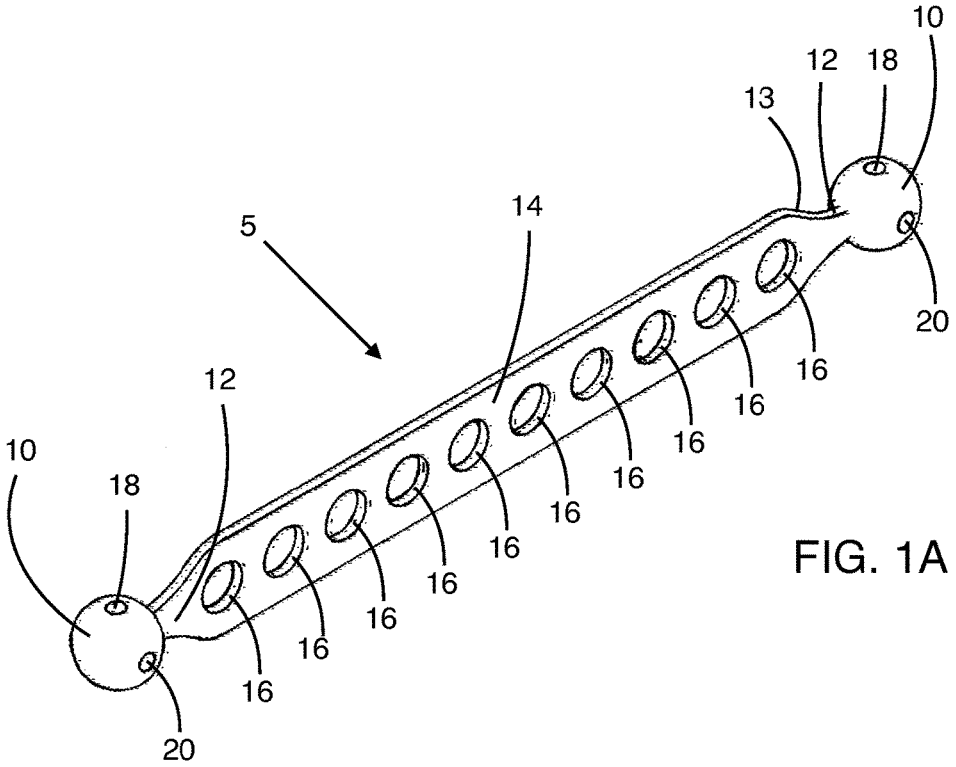
FIG. 1A is a perspective view of a fastener according to a first embodiment of the present invention.

The above-described drawing figures illustrate the invention, a fastener 5 that includes an elastic body 14 and at least one three-dimensional sphere-like head 10 ("head") that interlock with apertures 16 of the elastic body 14 for purposes of removably fastening ends 13 of the fastener 10 to the elastic body 14. The fastener 5 may be used for a wide range of purposes, such as fastening two elements together, as described in greater detail below.

Figure 1B:
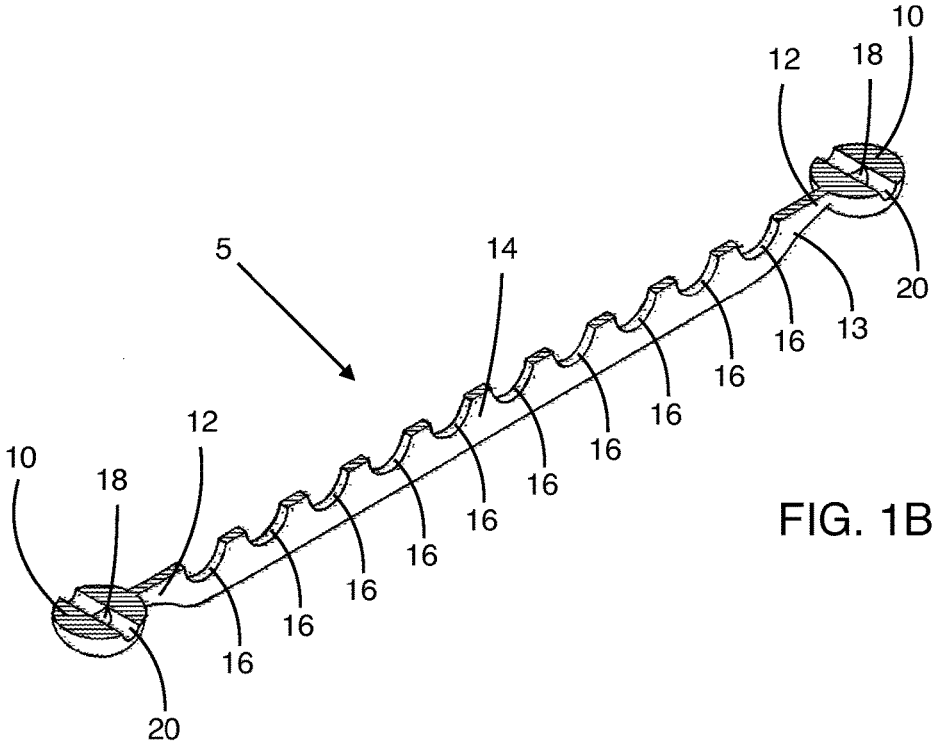
FIG. 1B is a perspective cross-sectional view thereof.

FIG. 1A is a perspective view of one embodiment of the fastener 5, and FIG. 1B is a perspective cross-sectional view thereof. As shown in FIGS. 1A and 1B, the fastener 5 includes at least one of the three-dimensional sphere-like heads 10, in this embodiment two of the heads 10. For purposes of this application, the term "three-dimensional sphere-like head" is defined to include any three dimensional figure with depth that is approximately equal to the width and height, with "approximately" being defined to mean within 20%. The sphere-like head may be spherical (defined to mean approximately spherical, not spherical in a strict geometric sense). In other embodiments, the sphere-like head may be cuboid, or similarly shaped (e.g., conical, pyramidal, etc.), as long as it appropriately proportioned to fit through the apertures 16 as discussed herein. The term "three-dimensional sphere-like head" specifically does not mean flat, planar, tape like constructions such as are shown in the prior art.

Each of the heads 10 may be integrally connected to the ends 13 of the elastic body 14 by a neck 12, as illustrated. In the present embodiment, the neck 12 has a diameter that is less than the width of the elastic body 14 or the diameter of the head 10. In one embodiment, the diameter of the neck 12 is approximately equal to the diameter of each of the apertures 16. In alternative embodiments, the heads 10 may be removably connected, as discussed below, or attached using other methods known in the art.

In one embodiment, the apertures 16 are round and having a diameter that is approximately equal to the neck 12. In one embodiment, there are at least six apertures 16 evenly spaced along the elastic body 14, preferably at least 10, and in some embodiments many more 50-100, or more.

As shown in FIGS. 1A and 1B, each head 10 may include bores 18 and 20, for receiving a pin 29 (illustrated in FIGS. 4A and 4B) or other form of rigid body therethrough, as discussed below. In this embodiment, one of the bores 18 is traverse to the elastic body 14, and the other bore 20 is orthogonal to the elastic body 14 (perpendicular to the bore 18). These features are discussed in greater detail below.

As shown in FIGS. 1A and 1B, the apertures 16 are sized and shaped to receive the head 10 therethrough, but not readily allow the head 10 to escape, thereby enabling the ends 13 to be removably fastened to the elastic body 14. While round apertures 16 are illustrated, other shapes may also be used, as long as they interact with the head 10 as required.

Figure 2A:
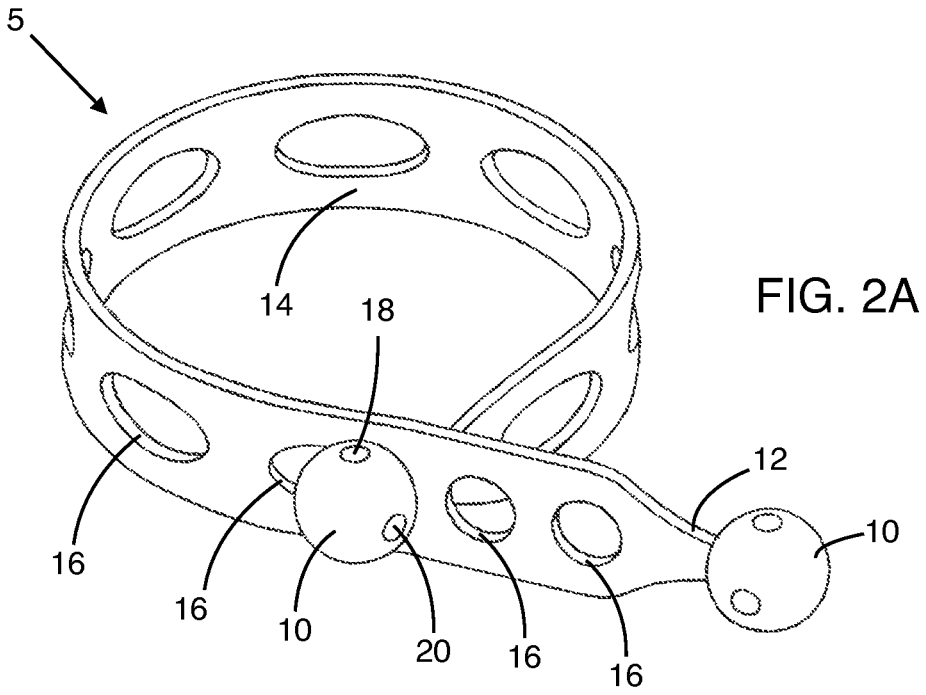
FIG. 2A is a perspective view of the fastener in a coiled configuration and being stretched, with one heads positioned through one of the apertures.
Figure 2B:
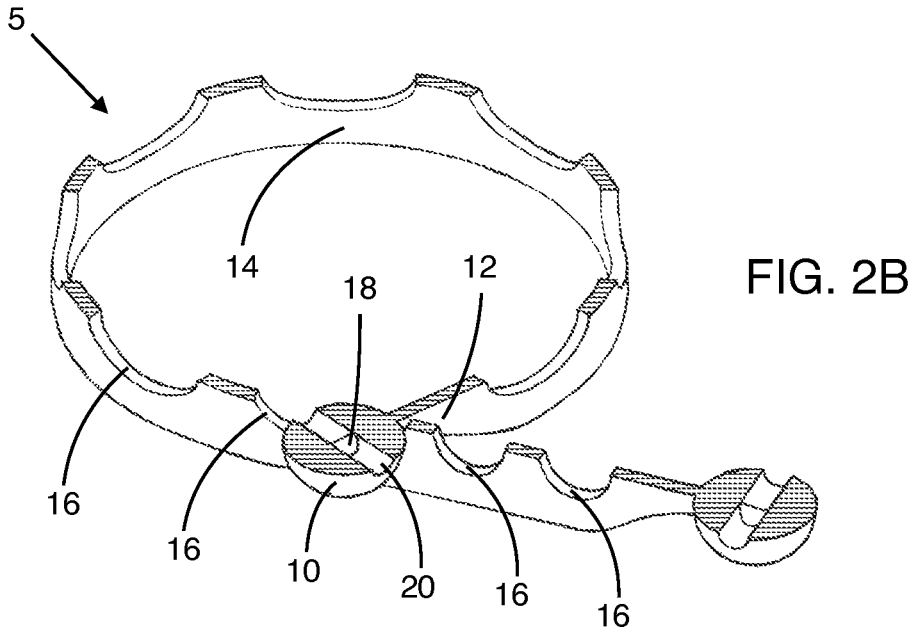
FIG. 2B is a perspective cross-sectional view thereof.

FIG. 2A is a perspective view of the fastener 5 is a looped configuration, illustrating one of the heads 10 being positioned through one of the apertures 16. FIG. 2B is a perspective cross-sectional view of the coiled fastener in FIG. 2A. As shown in FIGS. 2A and 2B, the fastener 5 is being stretched around elements (not shown), so that some of the apertures 16 are stretched to an oval shape.

Figure 3A:
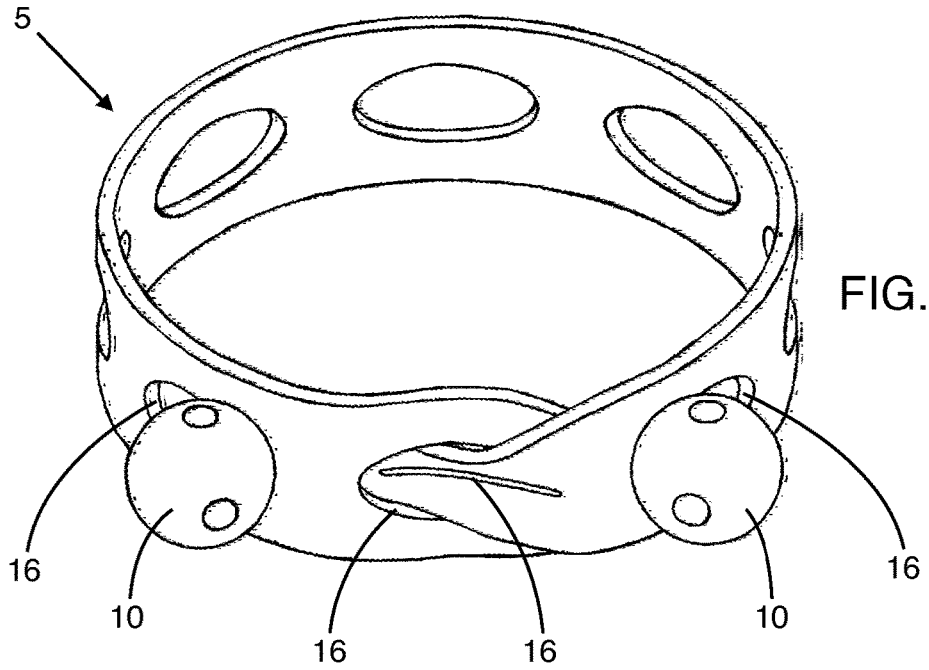
FIG. 3A is a perspective view of the fastener in another coiled configuration.
Figure 3B:
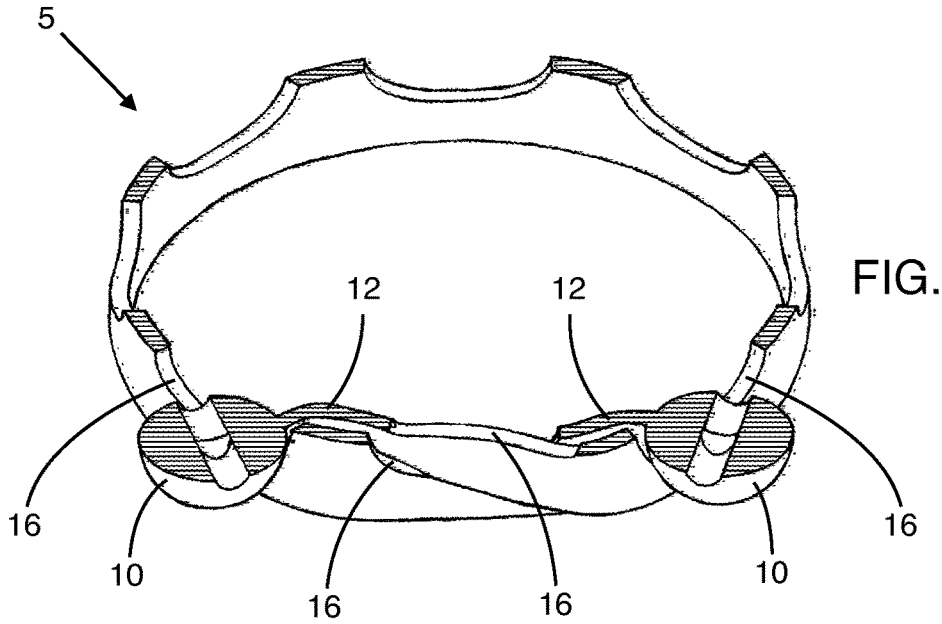
FIG. 3B is a perspective cross-sectional view thereof.

FIG. 3A is a perspective view the fastener 5 of FIG. 2A, once the second head 10 has been threaded through two adjacent apertures 16. FIG. 3B is a perspective cross-sectional view thereof. By engaging each of the heads 10, and further by threading one of the heads through two adjacent apertures 16, the ends 13 of the fastener 5 are firmly fixed to the elastic body 14, forming a circle or loop around any items that might need to be fastened together.

Figure 4A:
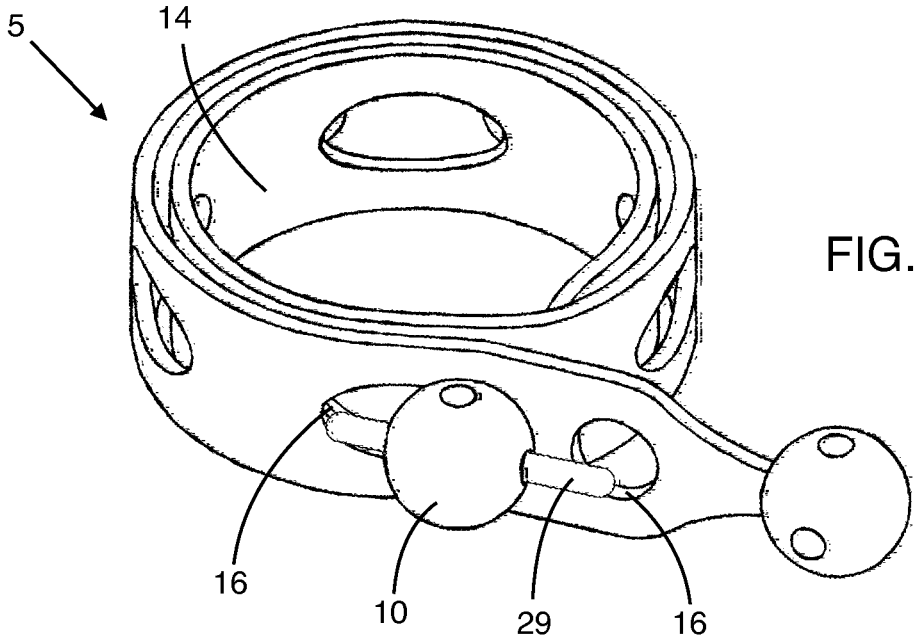
FIG. 4A is a perspective view of the fastener in yet another coiled configuration.
Figure 4B:
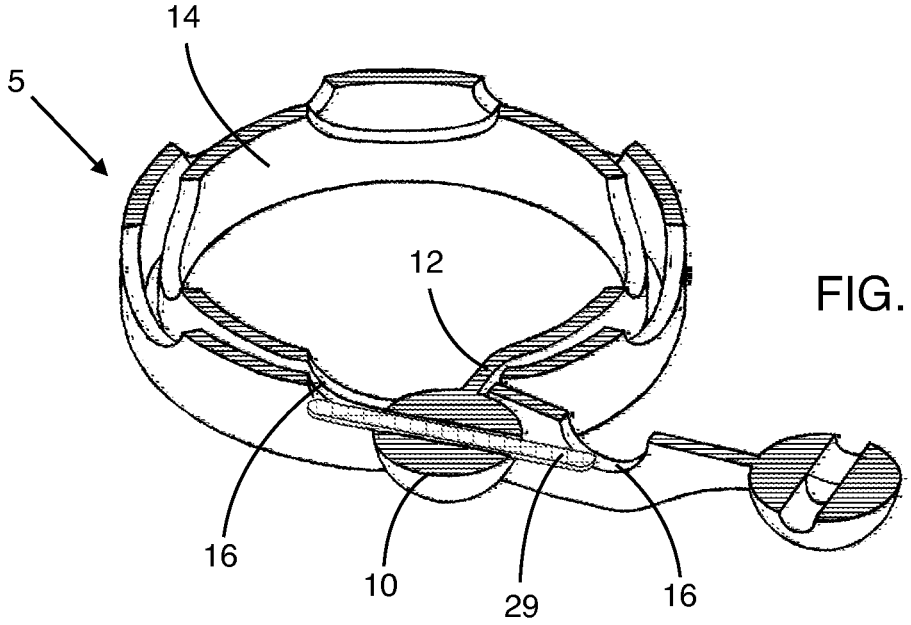
FIG. 4B is a perspective cross-sectional view thereof.

FIG. 4A is a perspective view of the fastener 5 that has been formed into a coil. FIG. 4B is a perspective cross-sectional view thereof. As shown in FIGS. 4A and 4B, the head 10 fits through two of the apertures 16 in different positions on the elastic body 14, to securely lock the fastener 5 into the coil configuration. The other head 10 could similarly be positioned through two of the apertures 16 as well, if desired.

FIGS. 4A and 4B also illustrate the use of the pin 29, as discussed above. The pin 29 fits through one or both of the heads 10, to further prevent the head 10 from slipping out of the apertures 16, once the fastener 5 has been adjusted as desired. While a particular shape of pin 29 is illustrated, a wide range of shapes and sizes may be used, to lock the head(s) 10 as desired.

Figure 5A:
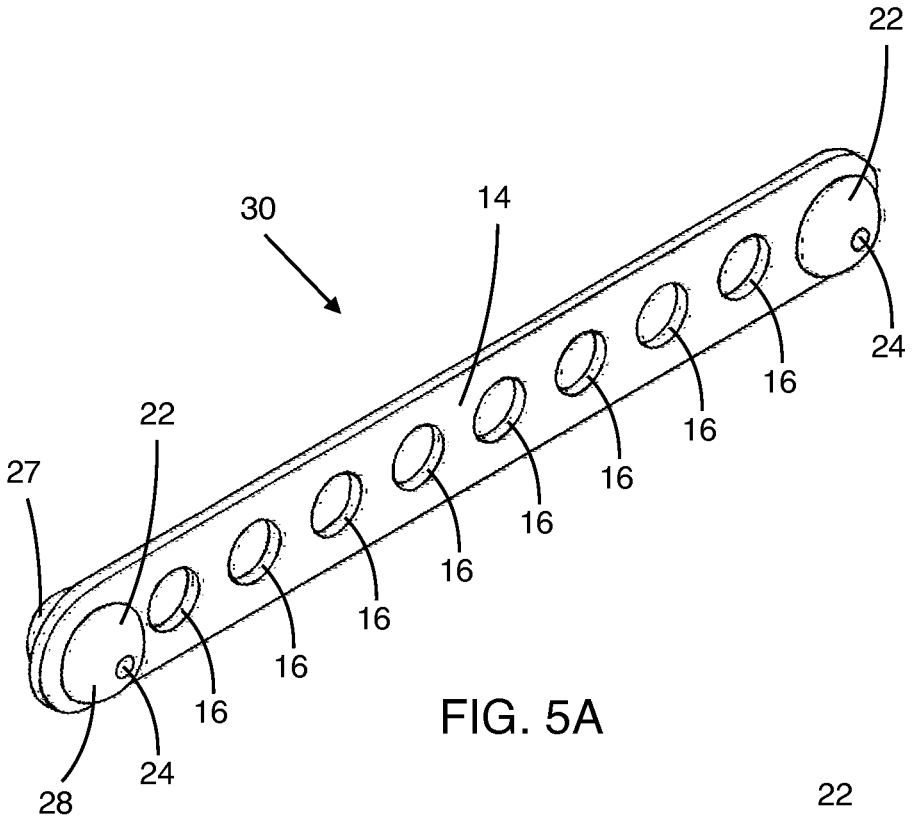
FIG. 5A is a perspective view of a second embodiment of the fastener, wherein the head is formed of a pair of reels.
Figure 5B:
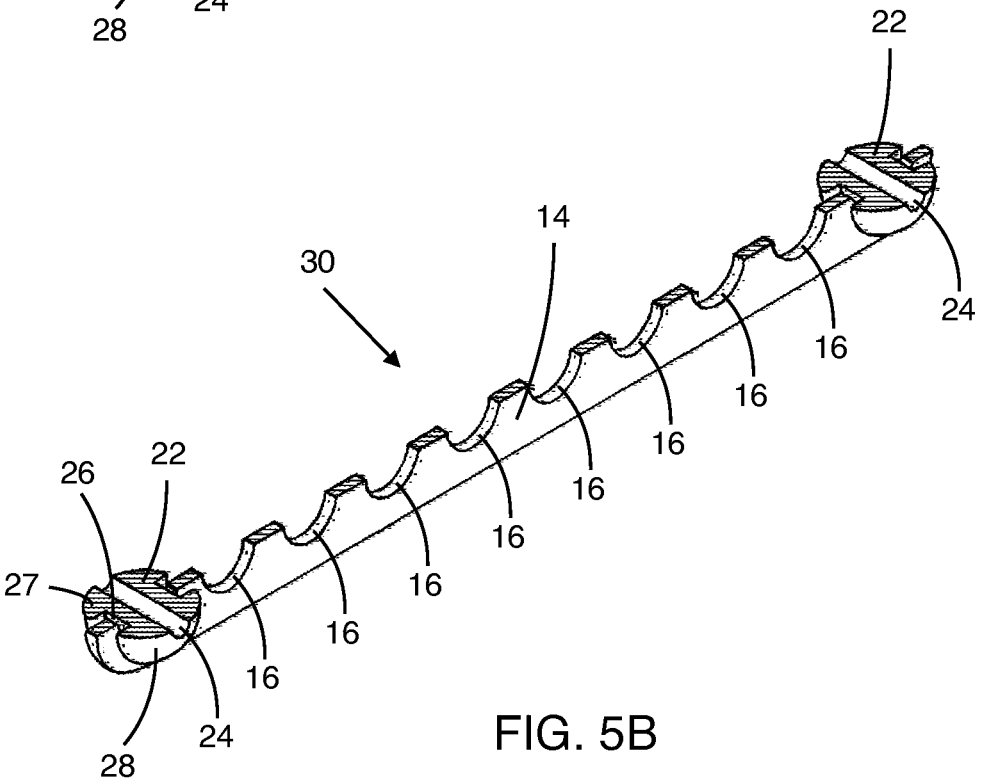
FIG. 5B is a perspective cross-sectional view thereof.

FIG. 5A is a perspective view of a second embodiment of the fastener 30, wherein the head 22 is formed of a pair of reels 27 and 28. FIG. 5B is a perspective cross-sectional view thereof. As shown in FIGS. 5A and 5B, the reels 27 and 28 are separated by a groove 26, and the groove 26 engages one of the apertures 16 to lock the reels 27 and 28 in place. The head 22 may further include a reel hole 24, which may be used to insert the pin 29 (shown in FIG. 4A) or other locking element known in the art.

Figure 6A:
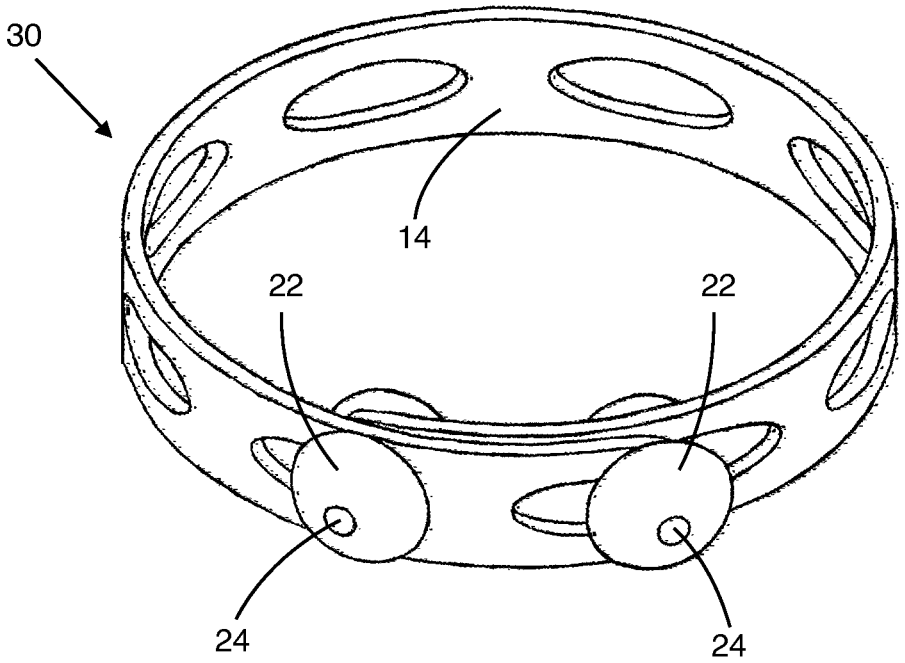
FIG. 6A is a perspective view of the fastener of FIG. 5A, illustrating each of the heads inserted partially through and engaging two of the apertures.
Figure 6B:
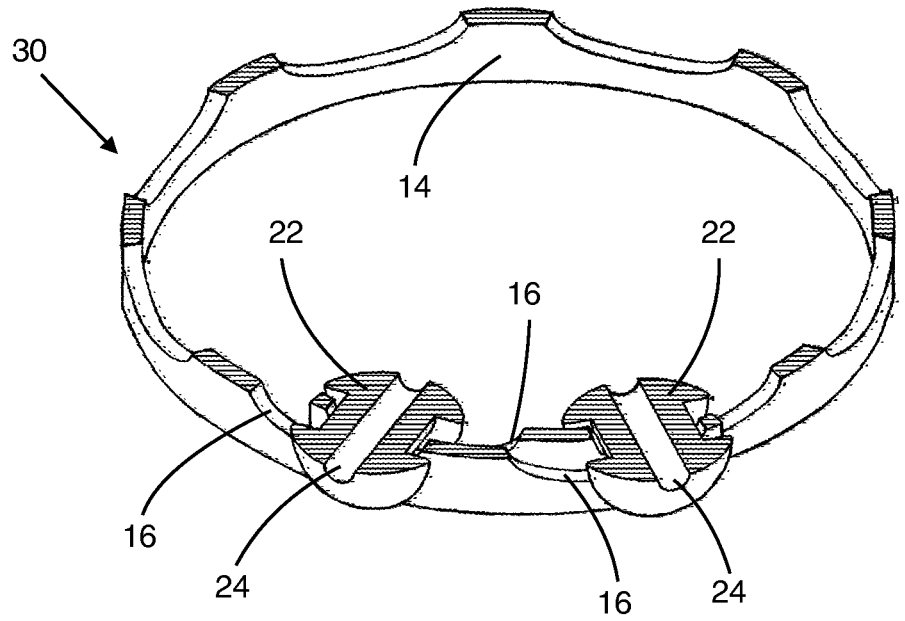
FIG. 6B is a perspective cross-sectional view thereof.

FIG. 6A is a perspective view of the fastener 30 of FIG. 5A, illustrating each of the heads 22 inserted partially through and engaging two of the apertures 16. FIG. 6B is a perspective cross-sectional view thereof. As shown in FIGS. 6A and 6B, each of the heads 22 lockingly engage two of the apertures 16, to lock the fastener 30 into a loop. In alternative embodiments, one of the heads 22 may be used, or alternatively, more than two could be used. Also, the heads 22 could be positioned in different locations, depending upon the size of the loop desired of the fastener 30.

Figure 6C:
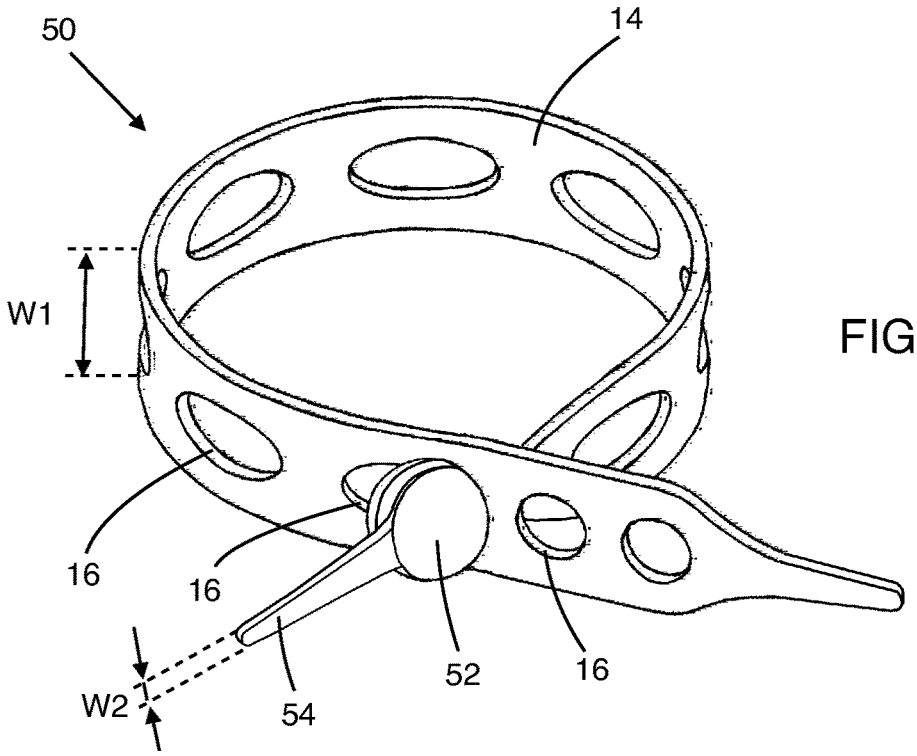
FIG. 6C is a perspective view of a third embodiment of the fastener having only one removable reel and a pull tab.
Figure 6D:
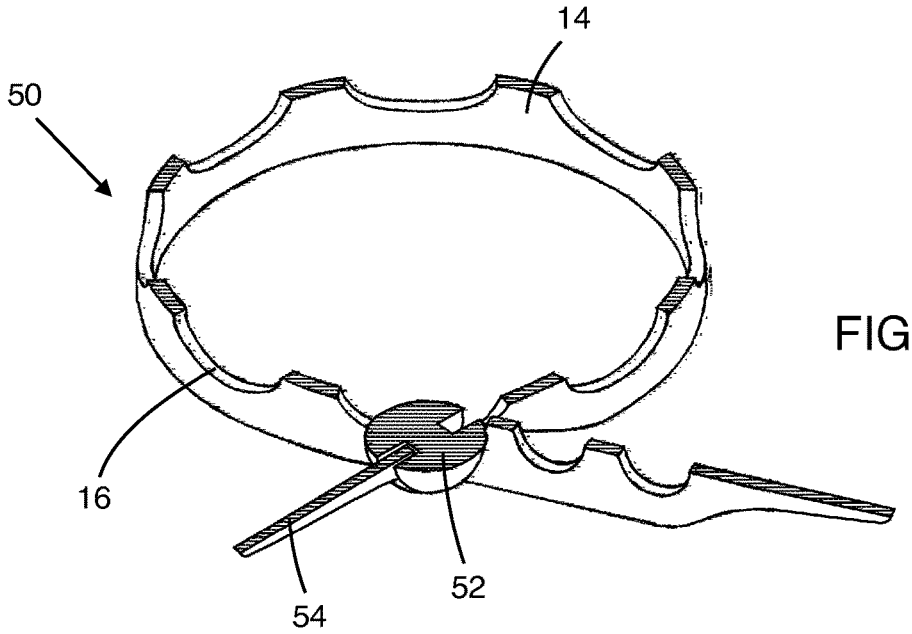
FIG. 6D is a perspective cross-sectional view thereof.

FIG. 6C is a perspective view of a third embodiment of the fastener 50. FIG. 6D is a perspective cross-sectional view thereof. As shown in FIGS. 6C and 6D, in the third embodiment, the fastener 50 has only one removable reel 52, and a pull tab 54 that extends outwardly from the removable reel 52. The pull tab 54 may be a rigid or semi-rigid tab or similar structure extending outwardly from the reel 52 (or head), opposite the elastic body 14. In one embodiment, the tab 54 has a width W2 that is less than a width W1 of the elastic body 14. In the present embodiment, the width W2 of the tab 54 is less than ½ the width W1 of the elastic body 14.

A similar fastener 50 may be provided may include an integral head 10, as in FIG. 1, rather than a removable reel 52 as shown. Furthermore, in the case of integral heads 10, two heads may initially be provided (as in FIG. 1), and one of the heads 10 may be cut off, if needed. There are many instances in which it may be desirable to cut off one of the heads 10, such as when the fastener 5 is being used to lace tennis shoes, or in other instances in which one end must be threaded through smaller openings. Only one head 10 is required for most embodiments, although two heads 10 may be used if the fastening requires extra strength. Furthermore, the fastener 5 is not abrasive, so it may be used in instances in which the fastener 5 is used with a delicate item (such as a cell phone) in which scratches are not desired. Also, the product does not include hooks and loops fasteners (i.e., Velcro®), which can be irritating, but instead only uses soft, resilient materials that do not scratch or irritate the user.

Figure 7:
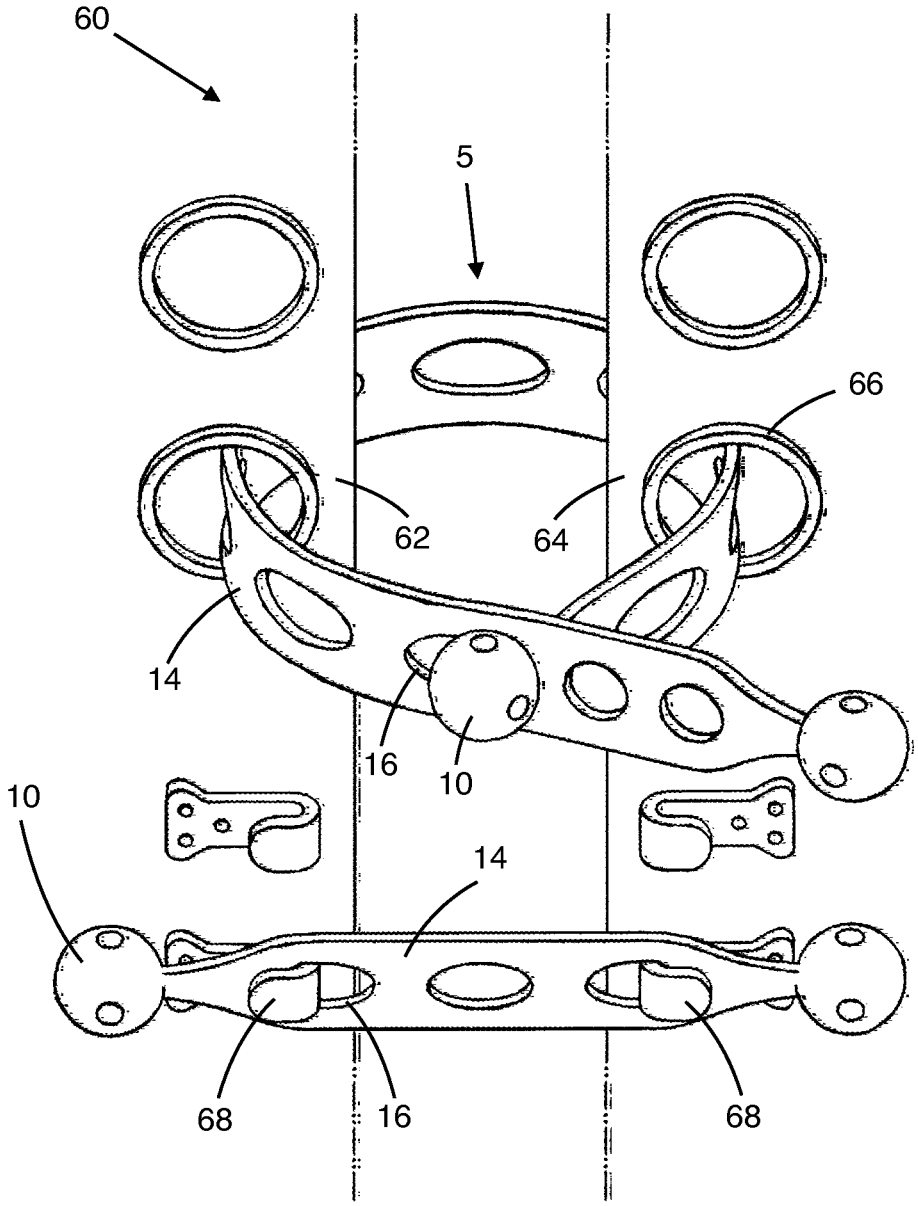
FIG. 7 is a perspective view of possible usage of fastener.

FIG. 7 is a perspective view of some possible usages of the fastener 5 of FIG. 1A, as well as a similar, smaller fastener. In this embodiment, a pair of elements 60 are fastened together, in this case a first element 62 and a second element 64, which each include an eyelet 66 or similar construction, and may include a grommet or similar reinforcing structure (i.e., in an upper of a shoe). The fastener 5 may be threaded through two or more eyelets 66 to removably fasten the two elements 62 and 64 together.

Similarly, hooks 68 may be provided, and the fastener 5 may be attached to the hooks 68 via the apertures 16 of the fastener 5.

Figure 8:
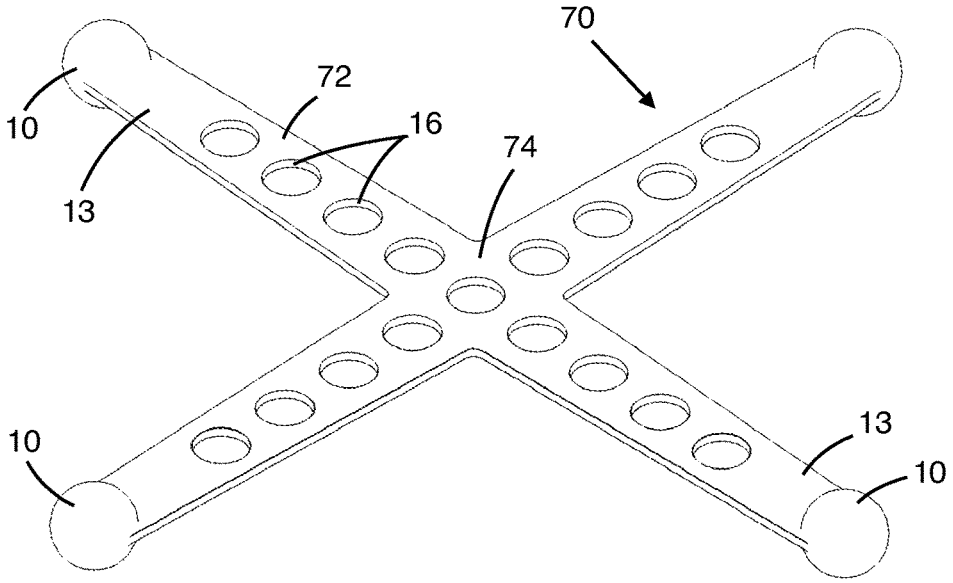
FIG. 8 is a perspective view of a fourth embodiment of the fastener.

FIG. 8 is a perspective view of a fourth embodiment of the fastener 70. As shown in FIG. 8, the fastener 70 may include multiple arms 72 (in this case, four) that extend from a center portion 74. Each arm 72 includes the apertures 16, extends to an end 13, and may include the head 10 (either an integral head, as in FIGS. 1A and 1B, or separate, as shown in FIGS. 5A and 5B).

Figure 9:
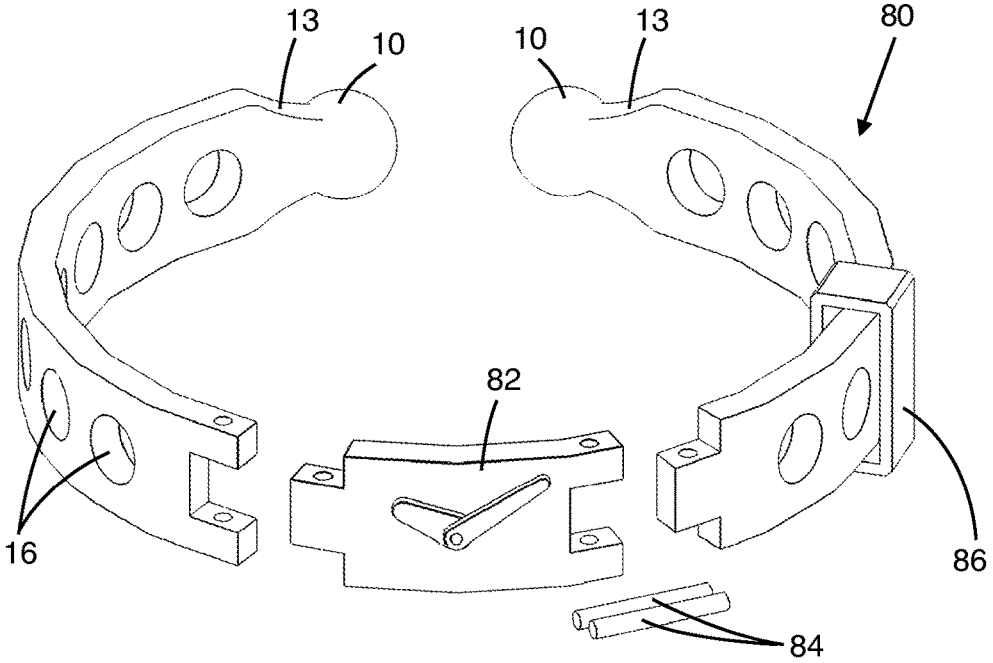
FIG. 9 is a perspective view of a fifth embodiment of the fastener, including a wristwatch integrated into the fastener.

FIG. 9 is a perspective view of a fifth embodiment of the fastener 80, including a wristwatch 82 (or other accessory, charm, etc.) integrated into the fastener 80. In this embodiment, the wristwatch 82 is attached with fasteners 84, in this case a rod through hinge construction, although other mechanisms known in the art may also be used. A slider 86 may also be included.

Figure 10:
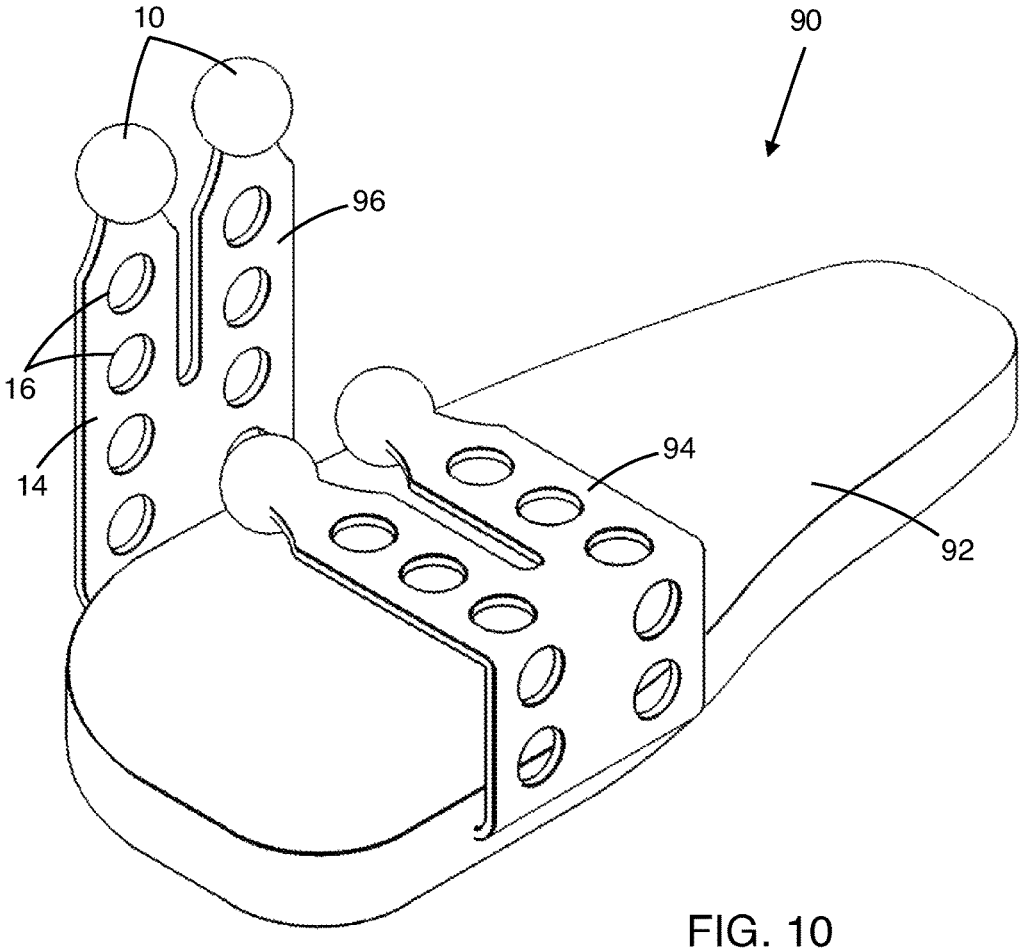
FIG. 10 is a perspective view of a uni-body footwear having a sixth embodiment of the fastener integrated therein.

FIG. 10 is a perspective view of a uni-body footwear 92 having a sixth embodiment of the fastener 90 integrated therein. As shown in FIG. 10, the footwear 92 may be any form of footwear known in the art, such as sandals, flip-flops, or other forms of footwear. The fastener 90 of this embodiment includes a first fastener construction 94 and a second fastener construction 96, which each includes one or more of the elastic bodies 14, the apertures 16, and the heads 10, as discussed above.

Figure 11A:
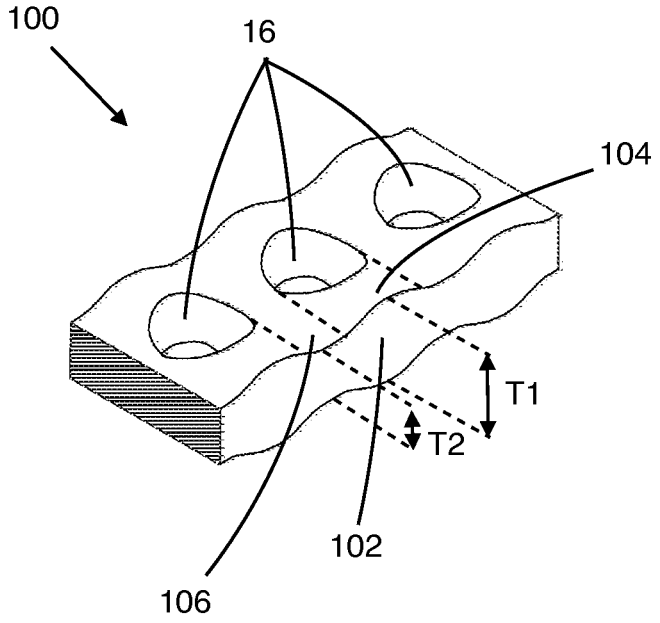
FIG. 11A is a perspective view of a portion of the fastener illustrating vertical bumps formed between each of the apertures and an edge of the elastic body of the fastener.

FIG. 11A is a perspective view of a portion 100 of one embodiment of the fastener (e.g., the fastener 5 of FIG. 1A) illustrating bridge portions 102 (e.g., vertical bumps) that may be formed between each of the apertures 16 and an edge 104 of the elastic body 14 of the fastener. As shown in FIG. 11A, the vertical bumps 102 each have a thickness T1 that is greater than the thickness T2 of main body portions 106 of the elastic body 14. The increased thickness of T1 over T2 may be great enough so that the strength of the elastic body 14 is not impaired in the locations of the apertures 16.

Figure 11B:
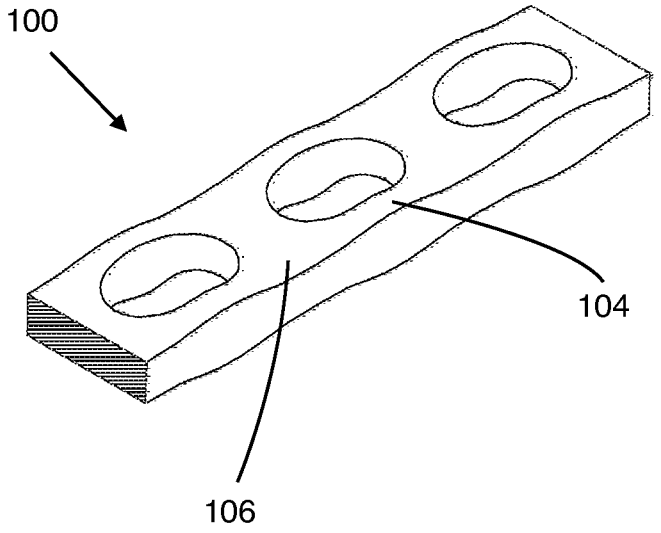
FIG. 11B is a perspective view of the portion of FIG. 11A, illustrating the portion being stretched to elongate the vertical bumps.

FIG. 11B is a perspective view of the portion 100 of FIG. 11A, illustrating the portion 100 being stretched to elongate the vertical bumps 102. As shown in FIG. 11B, the added thickness of T1 helps avoid weakened areas that may break under stress.

Figure 12:
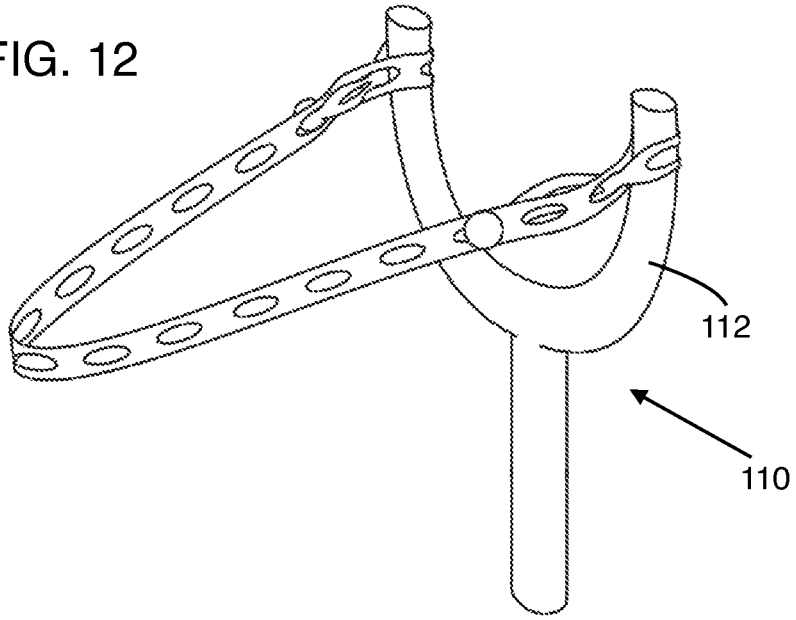
FIG. 12 is a perspective view of a sling-shot that incorporates the fastener of FIG. 1.

FIG. 12 is a perspective view of a sling-shot 110 that incorporates the fastener 5 of FIG. 1. As shown in FIG. 12, the fastener 5 of FIG. 1 may be used in conjunction with other articles to form a wide variety of toys and other items. The sling-shot 110 includes two vertical posts 112, and the fastener 5 of FIG. 1 is wrapped around the posts 112 to form the sling which may be used to launch items, as is known in the art. The length of the sling portion may be adjusted by adjusting the location of the head 10, as is discussed above.

Figure 13:
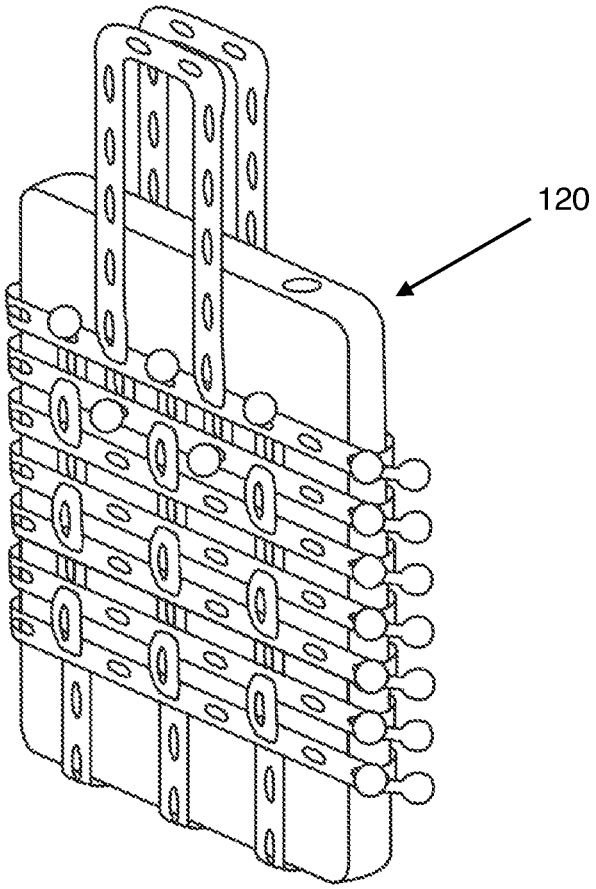
FIG. 13 is a perspective view of a woven article formed from a plurality of the fasteners of FIG. 1.

FIG. 13 is a perspective view of a woven article 120 formed from a plurality of the fasteners 5 of FIG. 1. As shown in FIG. 13, the fasteners 5 of FIG. 1 may be woven together to form the article 120, in this instance to form a case for a cell phone. The fasteners 5 may be interwoven in various manners to form a wide range of articles.

Operation

When using the fastener 5, shown in FIGS. 1 and 2, a user inserts the head 10 through one or more of the apertures 16 at desired fastening locations, to form a loop (as shown in FIGS. 2A and 2B, or alternatively, FIGS. 3A and 3B), or a coil (as shown in FIGS. 4A and 4B). The size of the loop or coil can be adjusted by selecting which apertures 16 are used.

The head(s) 10 can pass through the aperture(s) 16 because the elastic body 14 is elastic enough to permit the head 10 to fit through when suitable force is applied. Stretching the elastic body 14 narrows the width of the aperture 16, thus tightening the grip around the neck 12 and preventing head 10 from slipping. The head 10 is a great stopper because it has more volume like a sphere or a ball and it's not flat. This volume makes it easier to handle ends 13 compared to a flat tongue found in other fasteners. Prior art fasteners with flat heads or tails easily collapse.

As discussed above, the pin 29 can be inserted through one of the bores 18 or 20 to give a secondary barrier that prevents head 10 from slipping out of the aperture(s) 16. The fastener 5 may be made without the neck 12 and still work. The elastic body 14 may be pulled through the aperture 16 because its cross-sectional volume is less than that of the aperture 16. The elastic body 14 may attach to head 10 via the neck 12, which has a smaller diameter than the head 10, so that the neck 12 may more securely engage the aperture(s) 16.

In one embodiment, the head 10 functions like a button and the apertures 16 function like button holes or slits. The head 10 may be elastic or rigid, or of any other suitable construction known in the art. The head 10 and the aperture 16 configurations may include, but are not limited to, uni-head and uni-hole, uni-head and multi-holes, multi-heads and uni-hole, and multi-heads and multiple-holes. Two or more fasteners 5 can be fastened together to create a longer or larger fastener. Head 10 can be in between body holes 16. A blank section (not shown) can be added to body 14 to provide an extension. In case the head 10 is cut off, one can still use the fastener 5 by knotting the fastener, and the head 10 is provided by the knot (not shown). The knot has more volume than the rest of the body 14 and can function like head 10. Fastening is very efficient because one just needs body hole 16 over head 10. Unfastening is also very efficient because one just needs to pull the other head 10 or end in the uncoiling direction and head 10 will slip out.

To fasten items using the fastener 30 of FIGS. 5A and 6A, one inserts one side of reels 22 into body holes 16, coils around items, and buttons reels 22 (FIG. 6) into stretched body holes. The reel 22 can function like the head 10 of FIG. 1. A pin can be insert into and sticks out from both openings of reel hole 24 to give secondary barrier that prevents slippage. Reel 22 may need to be adjusted to accommodate the pin. One can use right-size nail through reel hole 24 to permanently mount reel 22. One or more reels 22 can be used. Reel 22 can be integrated into fastener to create one piece. A separate reel 22 needs to be rigid to firmly hold fastener. In case reel 22 is lost, one can create a knot using and on the fastener to function like head 10. Since material is elastic, multiple body holes 16 add degrees or levels of adjustments.

Fasteners (FIG. 7) can bring two parts together by coiling it through item holes, by slipping elastic body apertures onto hooks, or by a combination of both methods on both sides like but not limited to apparel, bags and footwear. First strap is inserted and coiled through two holes, fastened, and formed a closed loop. Second strap is fastened and latched onto two hooks without forming a closed loop.

The fastener 5 may be incorporated into a wide range of other items, including but not limited to apparel, bags, and footwear. One example of the uni-body rubber footwear is shown (FIG. 10), wherein the use of the fastener 5 simplifies the manufacturing process and provides a comfortable, easy to use product for the consumer. The use may also trim parts once he or she is comfortable with the fit.

Fastening of the fastener 5 may be accomplished by slipping the apertures 16 over hooks, studs, or similar items, or inserting the head 10 through one or more of the apertures 16. Some applications need no tension to be applied to close the loop. An open loop may be formed to be used for hanging items, etc. The fasteners 5 may also be used in different industries that require fastening. Furthermore, embellishments (not shown) may be attached to the fasteners 5 via the apertures 16.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A fastener comprising:

an elastic body that extends to opposed ends;

a three dimensional sphere-like head connected to at least one of the ends of the elastic body; and a plurality of apertures formed through the elastic body, the apertures being sized to enable the three dimensional sphere-like heads to be pushed through the aperture so that the aperture prevents the easy removal of the three dimensional sphere-like head, and wherein the three dimensional sphere-like head includes a bore therethrough.

2. The fastener of claim 1, wherein the three dimensional sphere-like head is spherical.

3. The fastener of claim 2, further comprising a pin shaped to fit through and frictionally engage the bore of the head so that pin ends of the pin extend outwardly from the head and prevent the head from being pulled out of the aperture.

4. The fastener of claim 1, wherein the three dimensional sphere-like heads includes a bore therethrough traverse to the elastic body.

5. The fastener of claim 1, wherein the three dimensional sphere-like head includes a bore therethrough orthogonal to the elastic body.

6. The fastener of claim 1, wherein the elastic body is a flat, planar construction.

7. The fastener of claim 1, wherein the head is integrally formed with the elastic body.

8. The fastener of claim 1, wherein the head has an annular groove that frictionally engages one of the apertures when the head is inserted therein.

9. The fastener of claim 1, wherein each of the heads is attached to the elastic body by a neck.

10. A fastener comprising:

an elastic body that extends to opposed ends;

a three dimensional sphere-like head connected to at least one of the ends of the elastic body;

a plurality of apertures formed through the elastic body, the apertures being sized to enable the three dimensional sphere-like head to be pushed through the aperture so that the aperture prevents the easy removal of the three dimensional sphere-like head; and a rigid or semi-rigid tab extending outwardly from the three dimensional sphere-like head, opposite the elastic body.

11. A fastener comprising:

an elastic body that extends to opposed ends;

a three dimensional sphere-like head connected to at least one of the ends of the elastic body;

a plurality of apertures formed through the elastic body, the apertures being sized to enable the three dimensional sphere-like head to be pushed through the aperture so that the aperture prevents the easy removal of the three dimensional sphere-like head; and wherein the thickness of bridge portions of the elastic body, located between each of the apertures and an edge of the elastic body, are greater than the thickness of main body portions of the elastic body, located between the apertures adjacent one another.

* * * * *